United States Patent [19]

Ouhadi et al.

[11] Patent Number: 4,839,084

[45] Date of Patent: Jun. 13, 1989

[54] BUILT LIQUID LAUNDRY DETERGENT COMPOSITION CONTAINING AN ALKALINE EARTH METAL OR ZINC SALT OF HIGHER FATTY ACID LIQUEFYING AGENT AND METHOD OF USE

[75] Inventors: Trazollah Ouhadi, Liege; Louis Dehan, Seraing; Marie L. Rossi, Flemalle, all of Belgium

[73] Assignee: Colgate-Palmolive Company, New York, N.Y.

[21] Appl. No.: 6,846

[22] Filed: Jan. 27, 1987

[51] Int. Cl.[4] ..... C11D 1/66

[52] U.S. Cl. ..... 252/174.21; 252/135; 252/140; 252/DIG. 1; 252/DIG. 14

[58] Field of Search ..... 252/174.21, 174.22, 252/DIG. 1, DIG. 14, 135, 140, 174.16, 174.25

[56] References Cited

U.S. PATENT DOCUMENTS

| | | | |
|---|---|---|---|
| 4,647,393 | 3/1987 | Ouhadi et al. | 252/174.22 |
| 4,655,954 | 4/1987 | Broze et al. | 252/174.21 |
| 4,661,280 | 4/1987 | Ouhadi et al. | 252/99 |
| 4,752,409 | 6/1988 | Drapier et al. | 252/174.25 |
| 4,753,750 | 6/1988 | Ouhadi et al. | 252/139 |

*Primary Examiner*—Paul R. Michl
*Assistant Examiner*—Hoa Van Le
*Attorney, Agent, or Firm*—Norman Blumenkopf; Murray M. Grill

[57] ABSTRACT

A liquid heavy duty laundry detergent composition comprising a suspension of builder salt in liquid non-ionic surfactant in which the pourability and physical stability of the composition is improved by the addition of small amounts of an alkaline earth metal or zinc salt of higher fatty acid, especially magnesium, calcium and zinc distearate. The yield stress is reduced and the pourability of the composition is improved especially at low concentrations of the alkaline earth metal or zinc salt.

27 Claims, No Drawings

BUILT LIQUID LAUNDRY DETERGENT COMPOSITION CONTAINING AN ALKALINE EARTH METAL OR ZINC SALT OF HIGHER FATTY ACID LIQUEFYING AGENT AND METHOD OF USE

BACKGROUND OF THE INVENTION (1) Field of Invention

This invention relates to nonaqueous liquid fabric treating compositions. More particularly, this invention relates to nonaqueous liquid laundry detergent compositions which are stable against phase separation and gelation and are easily pourable and to the use of these compositions for cleaning soiled fabrics.

(2) Prior Applications

The co-pending U.S. application Ser. No. 725,455, filed Apr. 22, 1985, is assigned to applicants' assignee and is directed to a liquid heavy duty laundry detergent composition comprising a suspension of builder salt in liquid nonionic surfactant and an aluminum tristearate stabilizing agent. The disclosure of Ser. No. 725,455 is incorporated herein in its entirety by reference thereto.

The co-pending U.S. application Ser. No. 744,754, filed June 14, 1985, is assigned to applicants' assignee and is directed to an aqueous thixotropic gel-like dishwashing detergent composition comprising a nonionic surfactant, an inorganic builder salt, a thixotropic clay thickener and about 0.1 to 0.2 percent of calcium, magnesium, aluminum or zinc stearate and the balance water.

(3) Discussion of Prior Art

Liquid nonaqueous heavy duty laundry detergent compositions are well known in the art. For instance, compositions of that type may comprise a liquid nonionic surfactant in which are dispersed particles of a builder, as shown for instance in the U.S. Pat. Nos. 4,316,812; 3,630,929 and 4,264,466.

Liquid detergents are often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are nondusting, and they usually occupy less storage space. Additionally, the liquid detergents may have incorporated in their formulations materials which could not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

The present inventors have been extensively involved in studying the rheological behavior of nonionic liquid surfactant systems with and without particulate matter suspended therein. Of particular interest has been nonaqueous built laundry liquid detergent compositions and the problems of gelling associated with nonionic surfactants as well as settling of the suspended builder and other laundry additives. These considerations have an impact on, for example, product pourability, dispersibility and stability.

The rheological behavior of the nonaqueous built liquid laundry detergents can be analogized to the rheological behavior of paints in which the suspended builder particles correspond to the inorganic pigment and the nonionic liquid surfactant corresponds to the nonaqueous paint vehicle. For simplicity, in the following discussion, the suspended particles, e.g. detergent builder, will sometimes be referred to as the "pigment".

It is known that one of the major problems with paints and built liquid laundry detergents it their physical stability. This problem stems from the fact that the density of the solid pigment particles is higher than the density of the liquid matrix. Therefore, the particles tend to sediment according to Stoke's law. Two basic solutions exist to solve the sedimentation problem: liquid matrix viscosity and reducing solid particle size.

For instance, it is known that such suspensions can be stabilized against settling by adding inorganic or organic thickening agents or dispersants, such as, for example, very high surface area inorganic materials, e.g. finely divided silica, clays, etc., organic thickeners, such as the cellulose ethers, acrylic and acrylamide polymers, polyelectrolytes, etc. However, such increases in suspension viscosity are naturally limited by the requirement that the liquid suspension be readily pourable and flowable, even at low temperatures. Furthermore, these additives do not contribute to the cleaning performance of the formulation.

Grinding to reduce the particle size provides the following advantages:

1. The pigment specific surface area is increased, and, therefore, particle wetting by the nonaqueous vehicle (liquid nonionic) is proportionately improved.

2. The average distance between pigment particles is reduced with a proportionate increase in particle-to-particle interaction. Each of these effects contributes to increase the rest-gel strength and the suspension yield stress while at the same time, grinding significantly reduces plastic viscosity.

The nonaqueous liquid suspensions of the detergent builders, such as the polyphosphate builders, especially sodium tripolyphosphate (TPP) in nonionic surfactant are found to behave, rheologically, substantially according to the Casson equation:

$$\sigma^{\frac{1}{2}}=\sigma_o^{\frac{1}{2}}+\eta_\infty^{\frac{1}{2}}\gamma$$

where $\gamma$ is the shear rate, $\sigma$ is the shear stress, $\sigma_o$ is the yield stress (or yield value), and $\eta_\infty$ is the "plastic viscosity" (apparent viscosity at infinite shear rate).

The yield stress is the minimum stress necessary to induce a plastic deformation (flow) of the suspension. Thus, visualizing the suspension as a loose network of pigment particles, if the applied stress is lower than the yield stress, the suspension behaves like an elastic gel and no plastic flow will occur. Once the yield stress is overcome, the network breaks at some points and the sample begins to flow, but with a very high apparent viscosity. If the shear stress is much higher than the yield stress, the pigments are partially shear-deflocculated and the apparent viscosity decreases. Finally, if the shear stress is much higher than the yield stress value, the pigment particles are completely shear-deflocculated and the apparent viscosity is very low, as if no particle interaction were present.

Therefore, the higher the yield stress of the suspension, the higher the apparent viscosity at low shear rate and the better is the physical stability of the product.

In addition to the problem of settling or phase separation the nonaqueous liquid laundry detergents based on liquid nonionic surfactants suffer from the drawback that the nonionics tend to gel when added to cold water. This is a particularly important problem in the ordinary use of European household automatic washing machines where the user places the laundry detergent composition in a dispensing unit (e.g. a dispensing drawer) of the machine. During the operation of the machine the detergent in the dispenser is subjected to a stream of cold water to transfer it to the main body of wash solution. Especially during the winter months when the detergent composition and water fed to the dispenser are particularly cold, the detergent viscosity increases markedly and a gel forms. As a result some of the composition is not flushed completely off the dispenser during operation of the machine, and a deposit of the composition builds up with repeated wash cycles, eventually requiring the user to flush the dispenser with hot water.

The gelling phenomenon can also be a problem whenever it is desired to carry out washing using cold water as may be recommended for certain synthetic and delicate fabrics or fabrics which can shrink in warm or hot water.

Partial solutions to the gelling problem have been proposed by the present inventors and others and include, for example, diluting the liquid nonionic with certain viscosity controlling solvents and gel-inhibiting agents, such as lower alkanols, e.g. ethyl alcohol (see U.S. Pat. No. 3,953,380), alkali metal formates and adipates (see U.S. Pat. No. 4,368,147), hexylene glycol, polyethylene glycol, etc. and nonionic structure modification and optimization. As an example of nonionic surfactant modification one particularly successful result has been achieved by acidifying the hydroxyl moiety end group of the nonionic molecule. The advantages of introducing a carboxylic acid at the end of the nonionic include gel inhibition upon dilution; decreasing the nonionic pour point; and formation of an anionic surfactant when neutralized in the washing liquor. Nonionic structure optimization has centered on the chain length of the hydrophobic-lipophilic moiety and the number and make-up of alkylene oxide (e.g. ethylene oxide) units of the hydrophilic moiety. For example, it has been found that a $C_{13}$ fatty alcohol ethoxylated with 8 moles of ethylene oxide presents only a limited tendency to gel formation.

Nevertheless, still further improvements are desired in the pourability, physical stability and gel inhibition of nonaqueous liquid fabric treating compositions.

Accordingly, it is an object of the invention to provide liquid fabric treating compositions which are suspensions of insoluble inorganic particles in a nonaqueous liquid and which are storage stable, easily pourable and dispersible in cold, warm or hot water.

Another object of this invention is to formulate highly built heavy duty nonaqueous liquid nonionic surfactant laundry detergent compositions which can be poured at all temperatures and which can be repeatedly dispersed from the dispensing unit of European style automatic laundry washing machines without fouling or plugging of the dispenser even during the winter months.

A specific object of this invention is to provide an easily pourable, nongelling, stable suspension of heavy duty built nonaqueous liquid nonionic laundry detergent composition which includes an amount of an alkaline earth metal or zinc fatty acid salt which is sufficient to decrease the yield stress of the composition to thereby increase its pourability and physical stability, or at least without adversely affecting its physical stability, i.e. settling of builder particles, etc.

These and other objects of the invention which will become more apparent from the following detailed description of preferred embodiments are generally provided by adding to the nonaqueous liquid suspension an amount of an alkaline earth metal or zinc fatty acid salt, especially a fatty acid salt of magnesium, zinc or calcium, effective to decrease yield stress and improve pourability of the composition while improving or at least without adversely affecting the physical stability of the composition, i.e. the settling of the suspended inorganic fabric treating particles, e.g. detergent builder, bleaching agent, antistatic agent, pigment, etc.

Accordingly, in one aspect the present invention provides a liquid heavy duty laundry composition composed of a suspension of a detergent builder salt in a liquid nonionic surfactant wherein the composition includes an amount of a magnesium, zinc or calcium fatty acid salt to decrease the yield stress of suspension and to improve its pourability.

According to another aspect, the invention provides a method for dispensing a liquid nonionic laundry detergent composition into and/or with cold water without undergoing gelation. In particular, a method is provided for filling a container with a nonaqueous liquid laundry detergent composition in which the detergent is composed, at least predominantly, of a liquid nonionic surface active agent and for dispensing the composition from the container into an aqueous wash bath, wherein the dispensing is effected by directing a stream of unheated water onto the composition such that the composition is carried by the stream of water into the wash bath.

DETAILED DESCRIPTION OF THE INVENTION

In accordance with the present invention the pourability of the suspension of the detergent builder compound or compounds and any other suspended additive, such as bleaching agent, etc., in the liquid vehicle is substantially improved by the addition of the liquefying agent which is an alkaline earth metal or zinc salt, preferably magnesium, calcium or zinc salt of a higher fatty acid.

The preferred higher aliphatic fatty acids will have from about 8 to about 22 carbon atoms, more preferably from about 10 to 20 carbon atoms, and especially preferably from about 12 to 18 carbon atoms. The aliphatic radical may be saturated or unsaturated and may be straight or branched. As in the case of the nonionic surfactants, mixtures of fatty acids may also be used, such as those derived from natural sources, such as tallow fatty acid, coco fatty acid, etc.

Examples of the fatty acids from which the alkaline earth metal or zinc salt liquefying agents can be formed include, decanoic acid, dodecanoic acid, palmitic acid, myristic acid, stearic acid, oleic acid, eicosanic acid, tallow fatty acid, coco fatty acid and mixtures of these acids, etc. The fatty acids from which the salts are made generally commercially available, and the alkaline earth metal or zinc salts are preferably used in the diacid form, e.g. magnesium stearate as magnesium distearate, i.e. $Mg(C_{17}H_{35}COO)_2$. The monoacid salts, e.g. magnesium monostearate, i.e. $Mg(OH)(C_{17}H_{35}35COO)$, and mixtures of the monoacid and diacid salts can also be used. It is most preferred, however, that the diacid magnesium, calcium or zinc salt comprises at least 30%, preferably at least 50%, especially preferably at least 80% of the total amount of alkaline earth metal or zinc fatty acid salt.

The magnesium, zinc and calcium salts can be easily produced by, for example, saponifying a fatty acid, e.g. animal fat, stearic acid, etc., followed by treatment of the resulting soap with magnesium, zinc or calcium oxides or hydroxides.

The increased pourability of the composition is manifested by a substantial decrease in the yield stress of the composition. Only very small amounts of the alkaline earth metal or zinc liquefying agent is required to obtain the significant improvements in pourability. For example, based on the total weight of the the composition, suitable amounts of alkaline earth metal or zinc salts, e.g. magnesium, calcium or zinc salt, that can be used are in the range of from about 0.1% to about 3%, preferably from about 0.3% to about 1%, and more preferably about 0.4% to about 0.8%.

In addition to its action as a liquefying agent, the alkaline earth metal and zinc fatty acid salts have the advantage that they are nonionic in character and are compatible with the nonionic surfactant component and do not interfere with the overall detergency of the composition.

NONIONIC SURFACTANT DETERGENT

The nonionic synthetic organic detergents employed in the practice of the invention may be any of a wide variety of such compounds, which are well known and, for example, are described at length in the text *Surface Active Agents,* Vol. II, by Schwartz, Perry and Berch, published in 1958 by Interscience Publishers, and in McCutcheon's *Detergents and Emulsifiers,* 1969 Annual, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 12. Of such materials it is preferred to employ those wherein the higher alkanol is a higher fatty alcohol of 10 to 11 or 12 to 15 carbon atoms and which contain from 5 to 8 or 5 to 9 lower alkoxy groups per mole. Preferably, the lower alkoxy is ethoxy but in some instances, it may be desirably mixed with propoxy, the latter, if present, often being a minor (less than 50%) proportion. Exemplary of such compounds are those wherein the alkanol is of 12 to 15 carbon atoms and which contain about 7 ethylene oxide groups per mole, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9, both of which are linear secondary alcohol ethoxylates made by Union Carbide Corp. The former is mixed ethoxylates product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company. Other useful nonionics are represented by the commercially well known class of nonionics sold under the trademark Plurafac. The Plurafacs are the reaction product of a higher linear alcohol and a mixture of the ethylene and propylene oxides, containing a mixed chain of ethylene oxide and propylene oxide, terminated by a hydroxyl group. Examples include Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide, Plurafac B26, and Plurafac RA50 (a mixture of equal parts plurafac D25 and Plurafac RA40).

Generally, the mixed ethylene oxide-propylene oxide fatty alcohol condensation products can be represented by the general formula $RO(C_2H_4O)_p(C_3H_6O)_qH$, wherein R is a straight or branched, primary or secondary aliphatic hydrocarbon, preferably alkyl or alkenyl, especially preferably alkyl, of from 6 to 20, preferably 10 to 18, especially preferably 14 to 18 carbon atoms, p is a number of from 2 to 12, preferably 4 to 10, and q is a number of from 2 to 7, preferably 3 to 6.

Another group of liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide; Dobanol 25-7 is an ethoxylated $C_{12}$–$C_{15}$ fatty alcohol with an average of 7 moles ethylene oxide; etc.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent and consequently, will preferably be omitted or limited in quantity in the present composition, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the ethylene oxide chains are highly preferred and are considered to result in the best combination of detergency, biodegradability and nongelling characteristics, medial or secondary joinder to the ethylene oxide in the chain may occur. It is usually in only a minor proportion of such alkyls, generally less than 20% but, as is in the cases of the mentioned Tergitols, may be greater. Also, when propylene oxide is present in the lower alkylene oxide chain, it will usually be less than 20% thereof and preferably less than 10% thereof.

When greater proportions of nonterminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and nongelling properties as the preferred compositions but use of the viscosity and gel controlling compounds of the invention can also improve the properties of the detergents based on such nonionics. In some cases, as when a higher molecular weight poly-lower alkoxylated higher alkanol is employed, often for its detergency, the proportion thereof will be regulated or limited in accordance with the results of routine experiments, to obtain the desired detergency and still have the produce nongelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures. Mixtures of two or more of these liquid nonionics can also be used and in some cases advantages can be obtained by the use of such mixtures.

As mentioned above, the structure of the liquid nonionic surfactant may be optimized with regard to their carbon chain length and configuration (e.g. linear versus branched chains, etc.) and their content and distribution of alkylene oxide units. Extensive research has shown that these structural characteristics can and do have a profound effect on such properties of the nonionic as pour point, cloud point, viscosity, gelling tendency, as well, of course, as on detergency.

Typically most commercially available nonionics have a relatively large distribution of ethylene oxide (EO) and propylene oxide (PO) units and of the lipophilic hydrocarbon chain length, the reported EO and PO contents and hydrocarbon chain lengths being overall averages. This "polydispersity" of the hydrophilic chains and lipophilic chains can have great importance of the product properties as can the specific values of the average values.

Another useful group of nonionic surfactants are the "Surfactant T" series of nonionics available from British Petroleum. The Surfactant T nonionics are obtained by the ethoxylation of secondary $C_{13}$ fatty alcohols and have a narrow ethylene oxide distribution. The Surfactant T5 has an average of 5 moles of ethylene oxide; Surfactant T7 an average of 7 moles of ethylene oxide; Surfactant T9 an average if 9 moles of ethylene oxide and Surfactant T12 an average of 12 moles of ethylene oxide per mole of secondary $C_{13}$ fatty alcohol.

In the compositions of this invention, a particularly preferred class of nonionic surfactants includes the $C_{12}$-$C_{13}$ secondary fatty alcohols with relatively narrow contents of ethylene oxide in the range of from about 7 to 9 moles, especially about 8 moles, and the $C_9$–$C_{11}$ fatty alcohols ethoxylated with about 5–6 moles ethylene oxide.

Mixtures of two or more of the liquid nonionic surfactants can be used and in some cases advantages can be obtained by the use of such mixtures.

Polycarboxylic Acid Terminated Nonionic Surfactant

Further improvements in the rheological properties of the liquid detergent compositions can be obtained by including in the composition a small amount of a nonionic surfactant which has been modified to convert a free hydroxyl group thereof to a moiety having a free carboxyl group, such as a partial ester of a nonionic surfactant and a polycarboxylic acid or anhydride.

As disclosed in the commonly assigned co-pending application Ser. No. 597,948, filed Apr. 9, 1984, the disclosure of which is incorporated herein by reference, the free carboxyl group modified nonionic surfactants, which may be broadly characterized as polycarboxylic acid terminated nonionic surfactants or as polyether carboxylic acids, function to lower the temperature at which the liquid nonionic forms a gel with water.

The addition of the polycarboxylic acid terminated nonionic surfactants to the liquid nonionic surfactant can decrease the yield stress of the dispersions, aid in the dispensibility of the composition, i.e. pourability, and lower the temperature at which the liquid nonionic surfactants form a gel in water without a decrease in their stability against settling. The acid terminated nonionic surfactant reacts in the washing machine water with the alkalinity of the dispersed builder salt phase of the detergent composition and acts as an effective anionic surfactant.

Specific examples of polycarboxylic acid terminated nonionic surfactants include the half-ester of Plurafac RA30 with succinic anhydride, the half ester of Dobanol 25-7 with succinic anhydride, etc. Instead of a succinic acid anhydride, other polycarboxylic acids or anhydrides may be used, e.g. maleic acid, maleic anhydride, glutaric acid, malonic acid, succinic acid, phthalic acid, phthalic anhydride, citric acid and the like.

The acid terminated nonionic surfactant as can be prepared as follows:

Acid Terminal $C_{13}$–$C_{15}$ nonionic Surfactant. 400g of nonionic surfactant which is a $C_{13}$–$C_{15}$ alkanol which has been alkoxylated to introduce 6 ethylene oxide and 3 propylene oxide unites per alkanol unit is mixed with 32g of succinic anhydride and heated for 7 hours at 100° C. The mixture is cooled and filtered to remove unreacted succinic material. Infrared analysis indicated that about one half of the nonionic surfactant has been converted to the acidic half-ester thereof.

Acid Terminated Dobanol 25-7. 522g of Dobanol 25-7 nonionic surfactant which is the product of ethyoxylation of a $C_{12}$–$C_{15}$ alkanol and has about 7 ethylene oxide units per molecule of alkanol is mixed with 100g of succinic anhydride and 0.1g of pyridine (which acts an an esterification catalyst) and heated at 260° C. for 2 hours, cooled and filtered to remove unreacted succinic material. Infrared analysis indicates that substantially all the free hydroxyls of the surfactant have reacted.

Acid Terminated Dobanol 91-5. 1000 g of Dobanol 91-5 nonionic surfactant which is the product of ethoxylation of a $C_9$–$C_{12}$ alkanol and has about 5 ethylene oxide units per molecule of alknaol is mixed with 265 g of succinic anhydride and 0.1g of pyridine catalyst and heated at 260° C. for 2 hours, cooled and filtered to remove unreacted succinic material. Infrared analysis indicates that substantially all the free hydroxyls of the surfactant have reacted.

Other esterification catalysts, such as an alkali metal alkoxide (e.g. sodium methoxide) may be used in place of, or in admixture with, the pyridine.

The acidic polyether compound, i.e. the polycarboxylic acid terminated nonionic surfactant, if present in the detergent composition, is preferably added dissolved in the nonionic surfactant.

Alkylene Glycol Mono Alkyl Ether Viscosity Control and Gel-Inhibiting Agents

Furthermore, in the compositions of this invention, it may be advantageous to include compounds with functions as viscosity control and gel-inhibiting agents for the liquid nonionic surface active agents such as low molecular weight amphiphilic compounds.

The viscosity control and gel inhibiting agents act to lower the temperature at which the nonionic surfactant will form a gel when added to water and improve the storage properties of the composition. Such viscosity control and gel inhibiting agents can be, for example, low molecular weight alkylene oxide lower mono-alkyl ether amphiphilic compounds. The amphiphilic compounds can be considered to be analogous in chemical structure to the ethoxylated and/or propoxylated fatty alcohol liquid nonionic surfactants but have relatively short hydrocarbon chain lengths ($C_2$–$C_8$) and a low content of ethylene oxide (about 2 to 6 ethylene oxide groups per molecule).

Suitable amphiphilic compounds are represented by the following general formula $$R^2O(\overset{R^2}{\overset{|}{C}}HCH_2O)_nH$$

where $R^1$ is a $C_2$–$C_8$ alkyl group, $R^2$ is hydrogen or methyl, and n is a number of from about 1 to 6, on average.

Specifically, the compounds are lower ($C_2$–$C_2$) alkylene glycol mono-lower ($C_2$–$C_5$) alkyl ethers. More specifically the compounds are mono-, di-, or tri-lower ($C_2$–$C_3$) alkylene glycol mono-lower ($C_1$–$C_5$) alkyl ethers.

Specific examples of suitable amphiphilic compounds include ethylene glycol monoethyl ether $C_2H_5$—O—$CH_2CH_2OH$, diethylene glycol monobutyl ether $C_4H_9$—O—$(CH_2CH_2O)_2H$, tetraethylene glycol monobutyl ether $C_4H_7$—O—$(CH_2CH_2O)_4H$ and dipropylene glycol monomethyl ether $$CH_3—O—(\overset{CH_3}{\overset{|}{C}}HCH_2O)_2H.$$

Diethylene glycol monobutyl ether is especially preferred.

The inclusion in the composition of the lower molecular weight lower alkylene glycol mono alkyl ether decreases the viscosity of the composition, such that it is more easily pourable, improves the stability against settling and improves the dispersibility of the composition on the addition to warm water or cold water.

The compositions of the present invention have improved viscosity and stability characteristics and remain stable and pourable at temperatures as low as about 5° C. and lower.

Stabilizing Agent

White the alkaline earth metal fatty acid and zinc and zinc salts are also effective as physical stabilizing agents, further improvements may be achieved in certain cases by incorporation of other physical stabilizers, such as, for example, an acidic organic phosphorus compound having an acidic—POH group, such as a partial ester of phosphorous acid and an alkanol, i.e. an alkanol ester of phosphoric acid.

As disclosed in the commonly assigned co-pending application Ser. No. 597,793, filed Apr. 6, 1984, the disclosure of which is incorporated herein by reference, the acidic organic phosphorus compound having an acidic—POH group can increase the stability of the suspension of builder, especially polyphosphate builders, in the nonaqueous liquid nonionic surfactant.

The acidic organic phosphorous compound may be, for instance, a partial ester of phosphoric acid and an alcohol such as an alkanol which have a lipophilic character, having, for instance, more than 5 carbon atoms, e.g. 8 to 20 carbon atoms.

A specific example is a partial ester of phosphoric acid and a $C_{16}$–$C_{18}$ alkanol (Empiphos 5632 from Marchon); it is made up of about 35% monoester and 65% diester.

The inclusion of quite small amounts of the acidic organic phosphorus compound makes the suspension significantly more stable against settling on standing but remains pourable, while, for the low concentration of stabilizer, e.g. below about 1%, its plastic viscosity will generally decrease. It is believed that the use of the acidic phosphorus compound may result in the formation of a high energy physical bond between the —POH portion of the molecule and the surfaces of the inorganic polyphosphate builder so that these surfaces take on an organic character and become more compatible with the nonionic surfactant.

Inorganic Detergent Builder

The invention detergent compositions also include water soluble and/or water insoluble detergent builder salts. Typical suitable builders include, for example, those disclosed in U.S. Pat. Nos. 4,316,812, 4,264,466, and 3,630,929. Water soluble inorganic alkaline builder salts which can be used alone with the detergent compound or in admixture with other builders are alkali metal carbonate, borates, phosphates, polyphosphates, bicarbonates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono- and diorthophosphate, and postassium bicarbonate. Sodium tripolyphosphate (TPP) is especially preferred. The alkali metal silicates are useful builder salts which also function to make the composition anticorrosive to washing machine parts. Sodium silicates of $Na_2O/SiO_2$ ratios of from 1.6/1 to 1/3.2, especially about ½ to 1/2.8 are preferred. Potassium silicates of the same ratios can also be used.

Another class of builders highly useful herein are the water insoluble aluminosilicates, both of the crystalline and amorphous type. The builders are particularly compatible with the alkaline earth metal and zinc distearate liquefying agents of this invention. Various crystalline zeolites (i.e. alumino-silicates) are described in British Pat. No. 1,504,168, U.S. Pat. No. 4,409,136, and Canadian Pat. Nos. 1,072,835 and 1,087,477, all of which are hereby incorporated by reference for such descriptions. An example of amorphous zeolites useful herein can be found in Belgium Pat. No. 835,351 and this patent too is incorporated herein by reference. These zeolites generally have the formula $$(M_2O)_x \cdot (Al_2O_3)_y \cdot (SiO_2)_z \cdot WH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq lg.

Other materials such as clays, particularly of the water insoluble types, may be useful adjuncts in compositions of this invention. Particularly useful is bentonite. This material is primarily montmorillonite which is a hydrated aluminum silicated in which about 1/6th of the aluminum atoms may be repaced by magnesium atoms and with which varying amounts of hydrogen, sodium, potassium calcium etc., may be loosely combined. The bentonite in its more purified form (i.e. free from any grit, sand, etc.) suitable for detergents invariably contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guan.

Organic Builder Salts

In certain geographical areas legislation has been enacted to limit the amount of polyphosphates that can be used in detergent compositions or to require that the polyphosphate detergent builders be entirely removed from the composition.

In such cases all or part of the polyphosphate detergent builder salts may be replaced by one or more of the above discussed inorganic or organic builder salts. Some of the particularly preferred organic builder salts are the alkali metal poly-acetal carboxylic acid builder salts, the alkali metal hydroxy acrylic acid polymer builder salts, and the alkali metal lower polycarboxylic acid builder salts.

The alkali metal poly-acetal carboxylic acid builder salts are disclosed in co-pending application Ser. No. 767,570, filed Aug. 19, 1985, which is assigned to applicants' assignee and which is incorporated herein by reference thereto.

The poly-acetal carboxylate detergent builder salts that can be used in the present invention have the following general formula

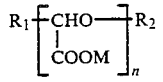

wherein M is selected from the group consisting of alkali metal, ammonium, alkyl groups having 1 to 4 carbon atoms; tetralkyl ammonium groups and alkanol amine groups having from 1 to 4 carbon atoms in the alkyl chain; the alkali metals are preferred, for example sodium and potassium; n is at least 4; and $R_1$ and $R_2$ are individually any chemically stable groups. $R_1$ and $R_2$ may be the same or different groups. The end groups $R_1$ and $R_2$ may be selected from a wide range of materials as long as they stabilize the poly-acetal carboxylate polymer against rapid depolymerization in an alkaline solution.

The number of the repeating groups, i.e. the value of n, is an important factor since the effectiveness of the poly-acetal carboxylate salt as a detergency builder is affected by the polymer chain length. Thus, in the poly-acetal carboxylate n can have a value between 10 and 400 units, i.e. n can equal 10 to 400, preferably n=50 to 200 and more preferably n=50 to 100 repeating units.

As an example, suitable chemically stable end groups include stable substituent moieties derived from otherwise stable compounds, such as alkanes, such as methane, ethane, propane and butane; alkenes such as ethylene, propylene and butylene; branched chain hydrocarbons, both saturated and unsaturated, such as 2-methyl butane and 2-methyl butene; alcohols such as methanol, ethanol, 2-propanol, cyclohexanol, polyhydric alcohols such as 1,2-ethane diol and 1,4-benzene diol; ethers such as methoxyethane methyl ether, ethyl ether, ethoxypropane and cylic ethers such as ethylene oxide; epichlorohydrin and tetramethylene oxide; aldehydes and ketones such as ethanol, acetone, propanol and methylethyl ketone; and carboxylate containing compounds such as the alkali metal salts of carboxylic acids, the esters of carboxylic acids and the anhydrides.

In a preferred embodiment of the invention $R_1$ is a member selected from the group consisting of $-OCH_3$, $-OC_2H_5$, $HO(CH_2CH_2O)_{1-4}-$,

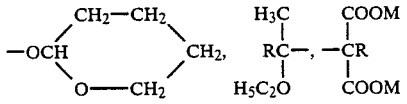

and mixtures thereof, and $R_2$ is a member selected from the group consisting of $-CH_3$, $-C_2H_5$, $-(CH_2CH_2O)_{1-4}H$,

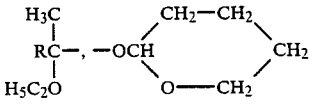

and mixtures thereof, where R is hydrogen or alkyl having 1 to 8 carbon atoms, and M is as defined above.

It is particularly preferred that $R_1$ is

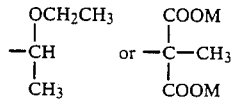

or mixtures thereof, and $R_2$ is

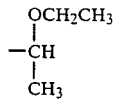

where M is sodium and n is 50 to 200.

The alkali metal hydroxy acrylic acid polymer builder salts are disclosed in co-pending application Ser. No. 767,535, filed Aug. 20, 1985, which is assigned to applicants' assignee and which is incorporated herein by reference thereto.

The hydroxy acrylic acid or salt polymer detergent builders used in accordance with the present invention are well known.

The lower molecular weight hydroxy acrylic acid and salt polymers are readily biodegradable. The hydroxy acrylic acid and salt polymers function as effective anti-incrustation agents. The hydroxy acrylate polymers are particularly good detergent builder salts because of their high sequestering capacity for calcium and magnesium ions in the wash water.

The hydroxy acrylate polymer used as a builder in accordance with the present invention contains monomeric units of the formula

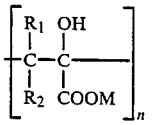

wherein $R_1$ and $R_2$ are the same or different and represent hydrogen or an alkyl group containing from 1 to 3 carbon atoms, and M represents hydrogen, or an alkali metal, alkaline earth metal or ammonium cation. The degree of polymerization, i.e. the value of n, is generally determined by the limit compatible with the solubility of the polymer in water.

The alkali metal lower polycarboxylic acid builder salts are disclosed in co-pending application Ser. No. 830,821, filed Feb. 19, 1986, which is assigned to applicants' assignee and which is incorporated herein by reference thereto. The disclosed organic builder salts comprises alkali metal salts of lower polycarboxylic acids, e.g. two to four carboxyl groups. The preferred sodium and potassium lower polycarboxylic acid salts are the citric and tartaric acid salts. The sodium citric acid salts are the most preferred, especially the trisodium citrate. The monosodium and disodium citrates can also be used. Where the monosodium and disodium citrates are used it is preferred to add as a supplemental builder salt sodium silicates, e.g. disodium silicate to adjust the pH to about the same level as obtained when using the trisodium citrate. The monosodium and disodium tartartic acid salts can also be used. The alkali metal lower polycarboxylic acid salts are particularly good builder salts; because of their high calcium and magnesium binding capacity they inhibit incrustation which could otherwise be caused by formation of insoluble calcium and magnesium salts.

Other suitable organic builders include carboxymethylsuccinates, tartronates and glycolates. Of special value are the poly-acetal carboxylates. The poly-acetal carboxylates and their use in detergent compositions are described in U.S. Pat. Nos. 4,144,226, 4,315,092, and 4,146,495. Other patents on similar builders include 4,141,676, 4,169,934, 4,201,858, 4,204,852, 4,224,420, 4,225,685, 4,226,960, 4,233,422, 4,233,423, 4,302,564, and 4,303,777. Also relevant are European patent application Nos. 0015024, 0021391, and 0063399.

Supplemental Builder

Since the compositions of this invention are generally highly concentrated, and, therefore, may be used at relatively low dosages, it is desirable to supplement any phosphate builder (such as sodium tripolyphosphate) with an auxiliary builder such as a polymeric carboxylic acid having high calcium binding capacity to inhibit incrustation which could otherwise be cause by formation of an insoluble calcium phosphate. Such auxilliary builders are also well known in the art. For example, mention can be made of Sokolan CP5 which is a copolymer of about equal moles of methacrylic acid and maleic anhydride, completely neutralized to form the sodium salt thereof.

Examples of organic alkaline sequestrant builder salts which can be used alone with the detergent or in admixture with other organic and inorganic builders are alkali metal, ammonium or substituted ammonium, aminopolycarboxylates, e.g. sodium and potassium ethylene diamine tetraacetate (EDTA), sodium and potassium nitrilotriacetates (NTA) and triethanol ammonium N-(2-hydroxyethyl)nitrilodiacetates. Mixed salts of these polycarboxylates are also suitable.

Bleaching Agent

The bleaching agents are classified broadly for convenience, as chlorine bleaches and oxygen bleaches. Chlorine bleaches are typified by sodium hypochlorite (NaOCl), potassium dichloroisocyanurate (50% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No. 4,264,466, or in column 1 of U.S. Pat. No. 4,430,244, the relevant disclosures of which are incorporated herein by reference. Polyacylated compounds are preferred activators; among these, compounds tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pats. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Suitable sequestering agents include, for example, NTA, EDTA, diethylene triamine pentaacetic acid ("DETPA"); diethylene triamine pentamethylene phosphonic acid ("DTPMP"); and ethylene diamine tetramethylene phosphonic acid ("EDITEMPA").

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

In addition to the detergent builders, various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidene suflone, etc., most preferred are stilbene and triazole combinations.

Bluing agents such as ultramarine blue; enzymes, preferably proteolytic enzymes, such as subtilisin, bromelin, papain, trypsin and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose, complex of $C_{12}$ to $C_{22}$ alkyl alcohol with $C_{12}$ to $C_{18}$ alkylsulfate; pH modifiers and pH buffers; color safe bleaches, perfume, and anti-foam agents or suds-suppressors, e.g. silicon compounds can also be used.

In a preferred form of the invention, the mixture of liquid nonionic surfactant and solid ingredients is subjected to an attrition type of mill in which the particle sizes of the solid ingredients are reduced to less than 40 microns, and preferably less than about 10 microns, e.g. to an average particle size of 2 to 10 microns or even lower (e.g. 1 micron). Preferably less than about 10%, especially less than about 5% of all the suspended particles have particle sizes greater than 10 microns. Compositions whose dispersed particles are of such small size have improved stability against separation or settling on storage. It is found that the acidic polyether compound, i.e. the polycarboxylic acid terminated nonionic surfactant, can decrease the yield stress of such dispersions, aiding in their dispensibility, without a corresponding decrease in their stability against settling.

In the grinding operation, it is preferred that the proportion of solid ingredients be high enough (e.g. at least about 40% such as about 50%) that the solid particles are in contact with each other and are not substantially shielded from one another by the nonionic surfactant liquid. Mills which employ grinding balls (ball mills) or similar mobile grinding elements have given very good results. Thus, one may use a laboratory batch attritor having 8mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 10 microns in the continuous ball mill.

In the preferred heavy duty liquid detergent compositions of the invention, typical proportions (based on the total composition, unless otherwise specified) of the ingredients are as follows:

Suspended detergent builder in the range of 10 to 60%, such as about 20 to 50%, e.g. about 25 to 40%.

The detergent builder can be an inorganic builder salt, e.g. alkali metal polyphosphate and/or organic builder salt, e.g. an alkali metal polyacetal carboxylic acid, an alkali metal hydroxy acrylic acid polymer or an alkali metal lower polycarboxylic acid salt. The organic builder salt can be substituted for part or for all of the alkali metal polyphosphate.

The liquid phase comprises at least one nonionic surfactant in an amount of about 20 to 70%, such as 30 to 60%, e.g. about 30 to 50%.

Polycarboxylic acid terminated nonionic surfactant in an amount of 0 to 20%, such as 3 to 20%, e.g. 5 to 16% or 4 to 10%. (Typically, the amount of the polycarboxylic acid terminated nonionic surfactant is in the range of about 0.01 to 1 part per one part of nonionic surfactant, such as about 0.05 to 0.6 part per one part, e.g. about 0.2 to 0.5 part per one part of the nonionic surfactant.)

The alkylene oxide monoalkyl ether amphiphilic gel-inhibiting compound is in an amount of 0 to 30%, such as about 5 to 30%, e.g. about 5 to 20%, or about 5 to 15%. (The weight ratio of the nonionic surfactant to amphiphilic compound when the later is present is in the range of from about 100:1 to 1:1, preferably from about 50:1 to about 2:1.)

The alkaline earth metal or zinc salt of a higher aliphatic fatty acid in an amount of at least 0.1%, such as 0.1 to about 3%, preferably about 0.3 to 1.5%, and more preferably about 0.5 to 1.0%.

Alkanol ester of phosphoric acid, as an anti-settling agent in an amount of 0 to 5%, such as about 0.01 to 5%, e.g. about 0.05 to 2%, or about 0.1 to 1%.

Alkali metal silicate in an amount of about 0 to 30%, such as 5 to 25%, e.g. 10 to 20%.

Copolymer of methacrylic acid and maleic anhydride alkali metal salt (Sokalan CP-5, anti-incrustation agent) in an amount of 0 to 10%, such as about 2 to 8%, e.g. about 3 to 5%.

Bleaching agent (e.g. alkali metal perborate monohydrate) in an amount of 0 to 30%, such as about 2 to 20%, e.g. about 5 to 16%.

Bleach activator in an amount of 0 to 15%, such as about 1 to 8%, e.g. about 2 to 6%.

Sequestering agent (e.g. Dequest 2066) in an amount of 0 to 3.0%, such as about 0.5 to 2.0%, e.g. about 0.75 to 1.25%.

Anti-redeposition agent (e.g. Relatin DM 4050) in an amount of 0 to 4.0%, such as 0.5 to 3.0%, e.g. 0.5 to 1.5%.

Optical brightener in an amount of 0 to 2.0%, such as 0.05 to 1.0%, e.g. 0.15 to 0.75%.

Enzymes in an amount of 0 to 3.0%, such as 0.5 to 2.0%, e.g. 0.75 to 1.25%.

Perfume in an amount of 0 to 3.0%, such as 0.10 to 1.25%, e.g. 0.25 to 1.0%.

Coloring agent in an amount of 0 to 4.0%, such as 0.1 to 4.0%, e.g. 0.1 to 2.0% or 0.1 to 1.0%.

Suitable ranges of optional detergent additives are: anti-foam agents and sud-suppressors—0 to 15%, preferably 0–5%, for example 0.1 to 3%; thickening agent and dispersants - 0 to 15%, for example 0.1 to 10%, preferably 1 to 5%; pH modifiers and pH buffers 0–5%, preferably 0 to 2%; and enzyme-inhibitors 0–15%, for example, 0.1 to 15%, preferably 0.1 to 10%.

In the selections of the adjuvants, they will be chosen to be compatible with the main constituents of the detergent composition. In this application, all proportions and percentages are by weight unless otherwise indicated. In the examples, atmospheric pressure is used unless otherwise indicated.

In an embodiment of the invention the detergent composition of a typical formulation is formulated using the blow named ingredients:

| | Weight % |
|---|---|
| Nonionic surfactant detergent. | 30–50 |
| Polycarboxylic acid terminated surfactant. | 3–20 |
| Phosphate detergent builder salt. | 0–60 |
| Organic builder salt. | 60–0 |
| Anti-incrustation agent. | 0–10 |
| Alkylene glycol monoalkylether anti-gel agent. | 5–15 |
| Alkaline earth metal or zinc fatty acid salt liquefying agent. | 0.2–1.0 |
| Anti-redeposition agent. | 0–4.0 |
| Alkali metal perborate bleaching agent. | 5–16 |
| Bleach activator (TAED). | 1.0–8.0 |
| Optical brightener. | 0.05–0.75 |
| Enzymes. | 0.75–1.25 |
| Perfume. | 0.1–1.0 |

The present invention is further illustrated by the following examples.

EXAMPLE 1

A concentrated nonaqueous liquid nonionic surfactant detergent composition is formulated from the following ingredients in the amounts specified.

| | Weight % |
|---|---|
| Nonionic surfactant.(1) | 38.7 |
| Polycarboxylic acid terminated nonionic.(2) | 5.0 |
| Sodium tripolyphosphate (TPP). | 30 |
| Diethylene glycol monobutylether anti-gel agent. | 10 |
| Liquefying agent-sample (a) | — |
| Sodium perborate monohydrate bleaching agent. | 9.0 |
| Tetraacetylethylene diamine (TAED) bleach activator. | 4.5 |
| Anti-redeposition agent (Relatin DM 4096)(3) | 1.0 |

-continued

| | Weight % |
|---|---|
| Optical brightener. | 0.2 |
| Perfume. | 0.6 |
| Enzyme (which is Esperase). | 1.0 |

(1)a 1:1 mixture of a $C_{13}$–$C_{15}$ fatty alcohol (7EO) and a $C_{13}$–$C_{15}$ fatty alcohol (5PE/10EO).

(2)A $C_9$–$C_{11}$ fatty alcohol (5E) reaction product with succinic anhydride at a 1:1 molar ratio.

(3)CMC/MC 2:1 mixture of sodium carboxymethyl cellulose and hydroxymethylcellulose.

The formulation is ground for about 1.0 hour to reduce the particle size of the suspended builder salts such that 90% are less than 10.0 mirons. After grinding the Esperase slurry is added with about 3% of the nonionic surfactant.

The above procedure is repeated with the substitution of about 0.5 weight percent of each of (b) aluminum tristearate, (c) magnesium distearate, (d) calcium distearate, and (e) zinc distearate, respectively, for 0.5% of the nonionic surfactant.

A sample of each of the (a) to (e) formulations is tested for yield stresss and plastic viscosity (apparent viscosity at infinite shear rate) and the following results are obtained.

| Stearate of | $\sigma_0$ Pa | $\eta_\infty$ Pa s |
|---|---|---|
| (a) none | 2.61 | 0.371 |
| (b) Aluminum | 4.73 | 0.294 |
| (c) Magnesium | 0.18 | 0.340 |
| (d) Calcium | 0.74 | 0.433 |
| (e) Zinc | 1.03 | 0.327 |

The magnesium, calcium and zinc distearate salts achieve a substantial reduction in yield stress and substantial improvement in pourability as compared with no additives and as compared with aluminum tristearate.

The stability of the formulations against settling is in each case of addition of magnesium, calcium and zinc distearates improved as compared to the aluminum tristearate formulation.

EXAMPLE 2

The above example samples (a) and (c) are repeated with the sodium perborate being increased from 9 to 16%, and with a corresponding decrease of the nonionic surfactant in the formulations.

The sample (a) formulation without the magnesium distearate is very pasty and nonliquid. The sample (c) formulation with the 0.5% magnesium distearate is fluid and easily pourable.

EXAMPLE 3

The Example 1 samples (a) and (c) are repeated with the substitution of sodium polyacetal carboxylic acid builder, sodium alphahydroxy acrylic acid polymer builder and sodium lower polycarboxylic acid builder in each case for the sodium tripolyphosphate builder (i.e. a total of six formulations are prepared). The results obtained are similar to those in Example 1, samples (a) and (c).

The Examples 1 to 3 formulations (samples (c) to (e)) are easily pourable, readily dispersible in water, stable and nongelling in storage.

The grinding of the builder salts can be carried out in part prior to mixing and grinding completed after mixing or the entire grinding operation can be carried out after mixing with the liquid surfactant. The formulations contain suspended builder and solid particles less than forty microns and preferably less than 10 microns in size.

It is understood that the foregoing detailed description is given merely by way of illustration and that variations may be made therein without departing from the spirit of the invention.

What is claimed is:

1. A nonaqueous liquid fabric treating composition which comprises 20 to 70% by weight of a liquid nonionic surfactant, 10 to 60% by weight of fabric treating inorganic particles suspended in the nonionic surfactant, and an effective amount of 0.1 to 3% by weight of an alkaline earth metal or zinc salt of a straight or branched, saturated or unsaturated carboxylic acid having about 8 to 22 carbon atoms to increase the pourability of the composition.

2. The composition of claim 1 wherein the aliphatic carboxylic acid is a straight or branched, saturated or unsaturated carboxylic acid having from about 10 about 20 carbon atoms.

3. The composition of claim 1 wherein the aliphatic carboxylic acid is a straight or branched, saturated or unsaturated carboxylic acid having from about 12 to about 18 carbon atoms.

4. The composition of claim 1 wherein the alkaline earth metal or zinc salt is at least one magnesium, calcium zinc stearate.

5. The composition of claim 1 wherein the inorganic particles comprise at least one of the following: inorganic detergent builders, bleaching agents, antistatic agents, and pigments.

6. The composition of claim 1 wherein the inorganic particles comprise an alkali metal polyphosphate detergent builder salt.

7. The composition of claim 1 wherein the inorganic particles comprise a crystalline aluminosilicate detergent builder salt.

8. The composition of claim 1 comprising an organic detergent builder salt.

9. The composition of claim 1 comprising at least one of an alkali metal polyacetal carboxylic acid builder salt, an alkali metal hydroxy acrylic acid polymer builder salt, and an alkali metal lower polycarboxylic acid builder salt.

10. The composition of claim 1 wherein the inorganic particles have a particle size distribution such that no more than about 10% by weight of said particles have a particle size of more than about 10 microns.

11. The composition of claim 1 which further comprises 3 to 20% by weight of a polycarboxylic acid terminated nonionic surfactant as a gel inhibiting agent in an amount to decrease the temperature at which the surfactant forms a gel with water.

12. The composition of claim 1 which contains from about 0.3 to about 1.5% by weight, based on the total composition, of said alkaline earth metal or zinc fatty acid salt.

13. The composition of claim 8 which further comprises an effective amount of 0.01 to 5% of an alkanol ester of phosphoric acid as a suspension stabilizing agent.

14. A nonaqueous liquid heavy duty, built laundry detergent composition which is pourable at high and low temperatures and does not gel when mixed with cold water, said composition comprising at least one liquid nonionic surfactant in an amount of from about 30 to about 60% by weight;

at least one detergent builder suspended in the nonionic surfactant in an amount of from about 20 to about 50% by weight;

an alkylene glycol mono alkyl ether gel inhibiting additive in an amount of about 5 to 20% by weight;

at least one of a magnesium, calcium or zinc salt of a $C_{12}$ to $C_{18}$ aliphatic carboxylic acid in an effective amount of from about 0.1 to about 3% by weight; and one or more detergent adjuvants selected from the following: enzymes, corrosion inhibitors, anti-foam agents, suds suppressors, soil suspending or anti-redeposition agents, anti-yellowing agents, colorants, perfumes, optical brighteners, bluing agents, pH modifiers, pH buffers, bleaching agents, bleach stabilizers, bleach activators and enzyme inhibitors.

15. The composition of claim 14 which comprise from about 40 to 60% of liquid nonionic surfactant; from about 20 to 60% by weight of detergent builder suspended in the nonionic surfactant; from about 5 to 15% by weight of said alkylene glycol mono alkyl ether; and from about 0.3 to about 1% of said magnesium, calcium or zinc salt.

16. The composition of claim 15 wherein the salt is magnesium stearate.

17. A method for cleaning soiled fabrics which comprises contacting the soiled fabrics with the laundry detergent composition of claim 14 in an aqueous wash bath.

18. The method of claim 17 wherein the salt is magnesium stearate.

19. A nonaqueous liquid heavy duty, built laundry detergent composition which is pourable at high and low temperatures and does not gel when mixed with cold water, said composition comprising a liquid nonionic surfactant in an amount of about 30 to 60% by weight;

a detergent builder suspended in the nonionic surfactant in an amount of about 20 to 50% by weight;

an effective amount of about 0.2 to 1.0% by weight of at least one of magnesium, calcium or zinc salt of a $C_{12}$ to $C_{18}$ aliphatic carboxylic acid.

20. The composition of claim 19 comprising an effective gel inhibiting amount of 5 to 20% by weight of an alkylene glycol monoalkyl ether.

21. The composition of claim 19 comprising magnesium stearate.

22. The composition of claim 19 comprising calcium stearate.

23. The composition of claim 19 comprising zinc stearate.

24. In a method for filling a container with a nonaqueous liquid laundry detergent composition in which the detergent is composed at least predominantly of a liquid nonionic surface active agent and for dispensing the composition from the container into a water bath in which the laundry is to be washed, wherein the dispensing is effected by directing a stream of unheated tap water onto the composition in the container whereby the composition is carried by the stream of water, into the water bath, the improvement comprising including in the nonaqueous composition from about 0.1 to about 3% by weight of at least one of magnesium, calcium or zinc salt of a $C_8$ to $C_{22}$ aliphatic carboxylic acid.

25. The method of claim 24 wherein the salt is magnesium stearate.

26. The method of claim 24 wherein the salt is calcium stearate.

27. The method of claim 24 wherein the salt is zinc stearate.

* * * * *